US010441493B2

(12) United States Patent
Adams et al.

(10) Patent No.: US 10,441,493 B2
(45) Date of Patent: Oct. 15, 2019

(54) MOBILITY DEVICE

(71) Applicant: PURDUE RESEARCH FOUNDATION, West Lafayette, IN (US)

(72) Inventors: Brett Francis Adams, Merrillville, IN (US); Andrew Fan, Granger, IN (US); Nikko George Sadural, Merrillville, IN (US); Junyan Lim, Columbus, IN (US); Jeffrey John Cargill, Seattle, WA (US); Sameer Chetan Saiya, Bellevue, WA (US)

(73) Assignee: Purdue Research Foundation, West Lafayette, IN (US)

( * ) Notice: Subject to any disclaimer, the term of this patent is extended or adjusted under 35 U.S.C. 154(b) by 0 days.

(21) Appl. No.: 15/789,573

(22) Filed: Oct. 20, 2017

(65) Prior Publication Data

US 2018/0110671 A1 Apr. 26, 2018

Related U.S. Application Data

(60) Provisional application No. 62/411,030, filed on Oct. 21, 2016.

(51) Int. Cl.
*A61H 3/00* (2006.01)
*A61H 3/02* (2006.01)

(52) U.S. Cl.
CPC ..... *A61H 3/00* (2013.01); *A61H 3/02* (2013.01); *A61H 3/0277* (2013.01); *A61H 2003/005* (2013.01); *A61H 2003/007* (2013.01); *A61H 2003/0211* (2013.01); *A61H 2201/0192* (2013.01); *A61H 2201/165* (2013.01)

(58) Field of Classification Search
CPC ..... A61H 3/0277; A61H 2003/005; A61H 2003/007; A61H 2003/0211; A63B 25/02; A63B 25/08; A61F 3/00
USPC ..... 135/69; 623/28, 29
See application file for complete search history.

(56) References Cited

U.S. PATENT DOCUMENTS

| | | | | |
|---|---|---|---|---|
| 6,494,919 | B1 | 12/2002 | Matthews | |
| 9,351,901 | B1 * | 5/2016 | Petsch | A63B 22/001 |
| 2008/0312049 | A1 * | 12/2008 | Ido | A61H 3/00 482/66 |
| 2010/0010641 | A1 * | 1/2010 | Kazerooni | A61H 3/00 623/26 |

* cited by examiner

*Primary Examiner* — David H Willse
(74) *Attorney, Agent, or Firm* — Hartman Global IP Law; Gary M. Hartman; Domenica N. S. Hartman

(57) ABSTRACT

A mobility device for assisting an individual with limited or altered mobility due to a leg injury or condition. The mobility device includes a rod that defines a longitudinal axis of the mobility device, a foot rest slidably mounted for longitudinal translation along the rod, a seat located at an upper end of the mobility device, and an impact-absorbing mechanism for absorbing impacts transferred from the seat to the rod. The device is configured for securing the thigh of the user's leg to the seat, and securing the foot of the user's leg to the foot rest.

18 Claims, 5 Drawing Sheets

MOBILITY DEVICE

CROSS REFERENCE TO RELATED APPLICATIONS

This application claims the benefit of U.S. Provisional Application No. 62/411,030, filed Oct. 21, 2016, the contents of which are incorporated herein by reference.

BACKGROUND OF THE INVENTION

The present invention generally relates to devices intended to assist individuals with limited or altered mobility due to a leg injury or condition.

According to Center for Disease Control (CDC) estimations, assistive devices such as canes, wheelchairs, walkers, and crutches are used by millions of people on a day-to-day basis. Individuals with permanent disabilities and those rehabilitating an injury depend on these devices for help with their mobility and daily activities.

Crutches are currently the most common assistive device used for rehabilitation of injuries to the lower leg. There are multiple kinds of crutches, a common type of which is the axilla, or axillary crutch. In use, the upper end of an axillary crutch rests below the user's armpit, medically referred to as the axilla, and the user grips a handgrip located roughly midway along the length of the crutch. The user walks by using the crutch for support in place of an injured leg.

Axillary crutches present challenges and problems for users. While using an axillary crutch, a user does not have use of their hands and arms, which makes it difficult to perform routine activities such as opening doors. Scaling stairs is very difficult and sometimes impossible using axillary crutches. Use of axillary crutches can require considerable physical exertion, and contact in the axilla can cause pain and injury. Despite their name, axillary crutches are intended to contact the user's body at the latissimus dorsi rather than the axilla. Patients can sustain nerve damage in the axilla due to incorrect positioning of the crutches.

In view of the above, there are ongoing efforts to research and design hands-free options to replace standard axillary crutches. Examples of such efforts include push scooters that brace the user's leg to allow the user to easily transport themselves without the worry of putting pressure on their injuries. Modified push scooters can be very effective for long walks, but can be difficult to manage indoors and in small spaces due to their size and weight. In addition, modified push scooters are relatively expensive compared to axillary crutches.

Another alternative is the iWalk™ knee brace, commercially available from iWALKFree, Inc. The iWalk™ transfers weight usually distributed to a user's injured foot to their knee, allows the user to walk hands-free with a nearly normal gait, and can be used to climb stairs. Other examples include the Rollerfoot™ knee scooter commercially available from Step Dynamics, LLC, which supports the user at their knee and is equipped with wheels for mobility, and the Freedom Leg™ commercially available from Forward Mobility, which is a crutch replacement that allows the user to walk almost normally without putting any pressure on the injured leg or foot.

While offering advantages over axillary crutches, the above-noted alternatives have certain limitations or disadvantages. For example, some apply a considerable amount of pressure to the knee, or cannot be used to scale stairs, or do not enable a smooth walking gait or position for the user.

BRIEF DESCRIPTION OF THE INVENTION

The present invention provides a mobility device suitable for assisting an individual with limited or altered mobility due to a leg injury or condition.

According to one aspect of the invention, the mobility device includes a rod that defines a longitudinal axis of the mobility device, a foot rest slidably mounted for longitudinal translation along the rod, a seat located at an upper end of the mobility device, an impact-absorbing mechanism for absorbing impacts transferred from the seat to the rod, means for securing the thigh of the user's leg to the seat, means for securing the foot of the user's leg to the foot rest, and means for adjusting a longitudinal length of the mobility device.

Technical aspects of the mobility device described above preferably include the ability to assist individuals with lower leg injuries to pursue a relatively active lifestyle. The device enables substantially hands-free use, can safely navigate stairs and uneven terrain, and emulates the natural gait of persons of a wide range of sizes and weights.

Other aspects and advantages of this invention will be further appreciated from the following detailed description.

DETAILED DESCRIPTION OF THE INVENTION

Figure 6:
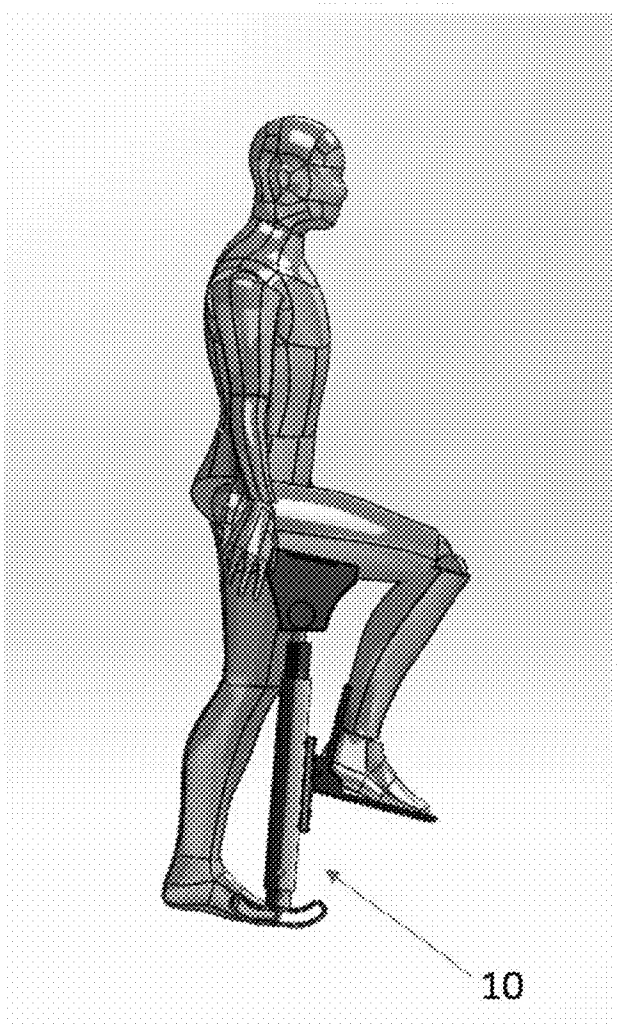
FIGS. 5 and 6 schematically represent a user using the mobility device of FIGS. 1 through 4.
Figure 5:
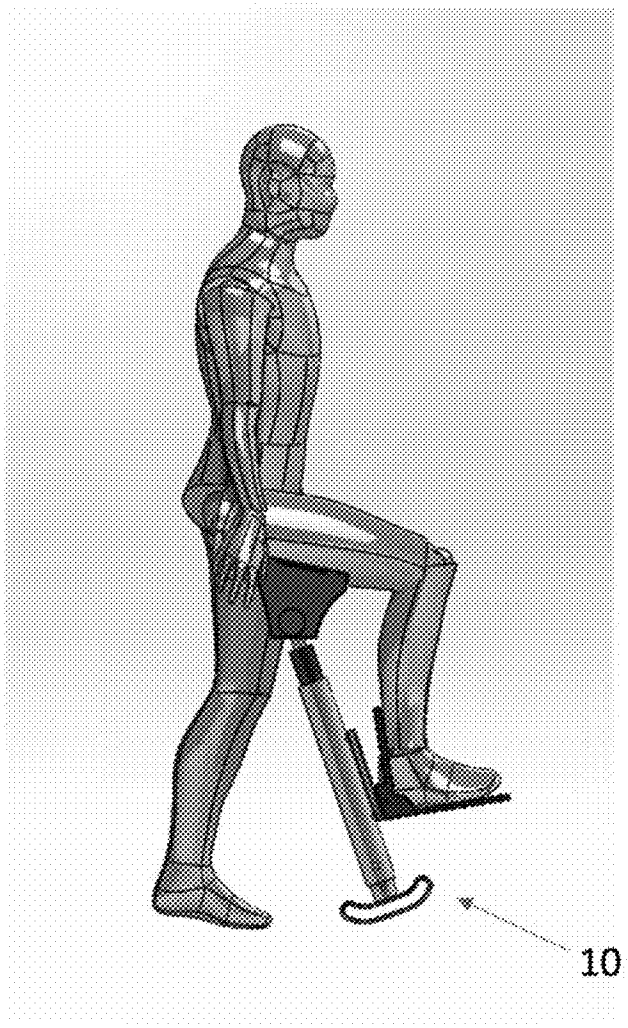

FIGS. 1 through 6 depict various views of a nonlimiting embodiment of a mobility device 10 intended to assist individuals with limited or altered mobility due to a leg injury or condition. To facilitate the description of the embodiment represented in the drawings, relative terms, including but not limited to, "vertical," "horizontal," "lateral," "front," "rear," "side," "forward," "rearward," "upper," "lower," "above," "below," "right," "left," etc., may be used in reference to the orientation of the mobility device during its use, for example, as depicted in FIGS. 5 and 6, and therefore are relative terms that indicate the construction and use of the invention but should not be necessarily interpreted as limiting the scope of the invention.

The mobility device 10 is particularly intended for use by individuals that have a lower leg injury or condition and yet desire to maintain an active lifestyle. As such, the mobility device 10 is configured to enable hands-free use by users, be safely and easily used to ascend stairs, and more accurately emulate or enable the normal gait of the particular user. As evident from FIGS. 5 and 6, the mobility device 10 is configured to be used with only the upper thigh and foot of a user's injured leg secured to the device 10, enabling hands-free use of the device 10. As illustrated in FIGS. 5 and 6, the upper thigh of a user's injured leg rests on a seat 12 that is preferably pivotally attached at an upper end of the device 10, and the foot of the user's injured leg is supported and secured with a roughly L-shaped sliding foot rest 14 that is slidably mounted to the side of the device 10. With this arrangement, the mobility device 10 does not distribute force to the lower leg (defined herein as portions of the leg below the knee), but instead distributes a user's weight between the user's thigh and seat 12 and between the user's foot and foot rest 14, and therefore away from an injured area of the user's lower leg.

The device 10 is preferably modular and adjustable to enable its use by individuals having a wide range of weights, heights, shapes, and lifestyles, as well as enable components of the device 10 to be interchanged to achieve a more optimal fit for a particular user. For this purpose, the device 10 preferably has the ability to adjust to at least one standard deviation of average adult male heights (roughly a 10-inch (25 cm) height gap), and adjustable to accommodate the average leg lengths of both males and females for two standard deviations of the mean (roughly a range of 70 to 105 cm).

Figure 3:
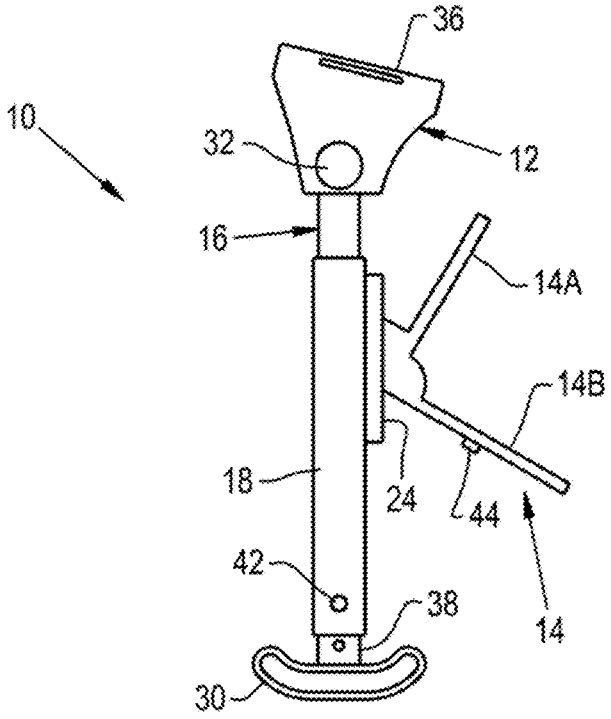
Figure 4:
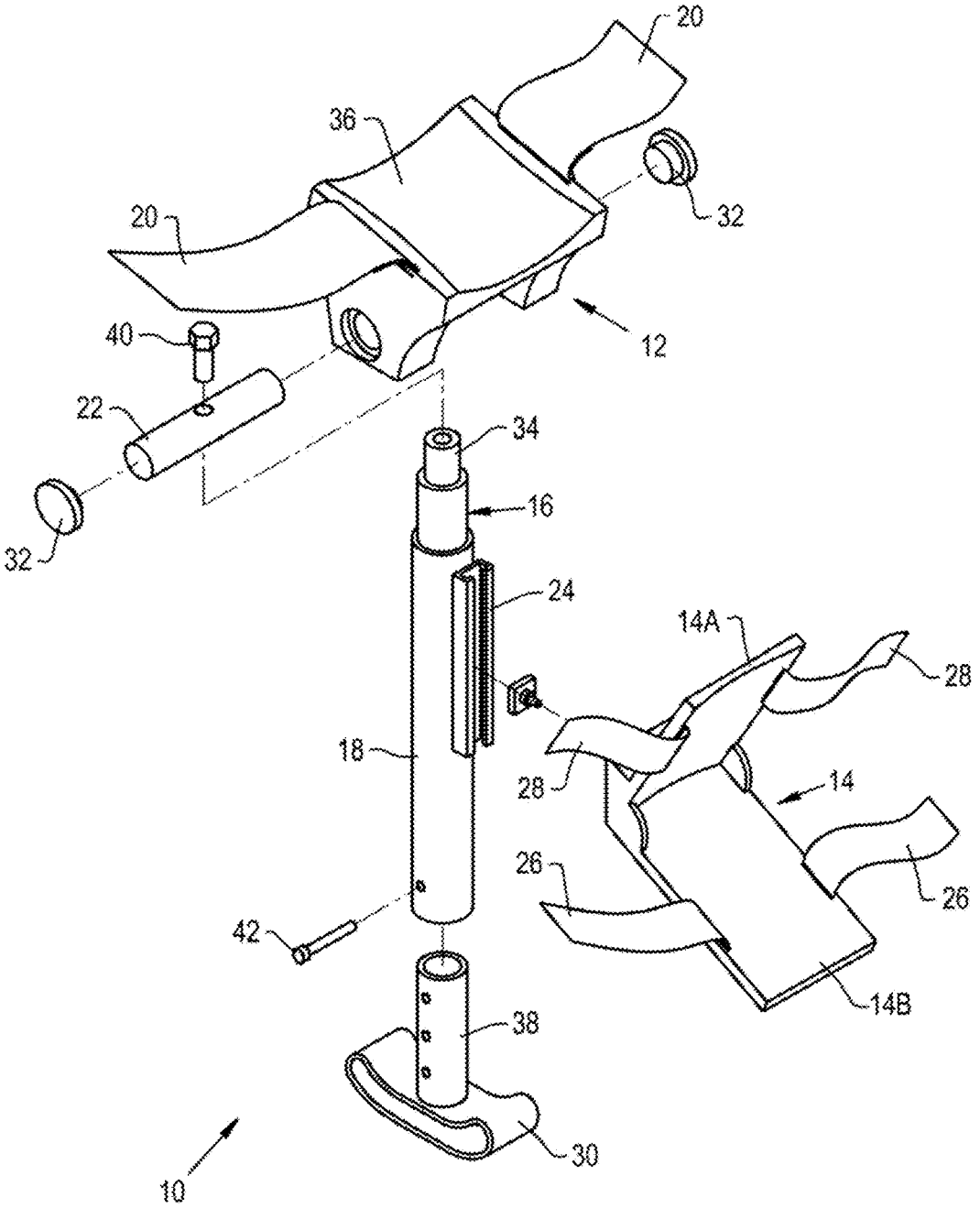
FIG. 4 is an exploded view of the mobility device of FIGS. 1 through 3.

Referring again to FIGS. 5 and 6, the mobility device 10 attaches to the user's thigh and performs similarly to a prosthetic leg, avoiding pressure on the lower leg as the user walks. The mobility device 10 features a gas spring 16 that interconnects the seat 12 to lower portions of the device 10 to provide shock absorption along the longitudinal axis of the device 10 and minimize the impact of each step of the user. As such, the gas spring 16 serves as an impact-absorbing mechanism that acts as a damping system when the user is walking. Suitable gas springs for use with the device 10 are commercially available, and alternatives to gas springs, including mechanical springs, are known to those skilled in the art. The efficacy of the gas spring 16 can be monitored with sensors mounted at various locations of the device 10. As an example, FIG. 3 depicts a pressure sensor 44 attached to a lower portion 14B of the foot rest 14, to which force is transmitted to a user's foot during use of the device 10. The sensor 44 or additional sensors could be placed elsewhere on the device 10, for example, on or in surfaces contacted by the user's lower leg or incorporated into one or more components along the longitudinal axis of the device 10.

As shown, the gas spring 16 is assembled with a foot rod 18, which together generally define a longitudinal axis of the device 10. The foot rod 18 can be configured as a tubular member that provides a support structure to which the foot rest 14 is attached, and in which the gas spring 16 can be installed to protrude from the upper end of the rod 18. Suitable but nonlimiting materials for the foot rod 18 include aluminum alloys.

Figure 1:
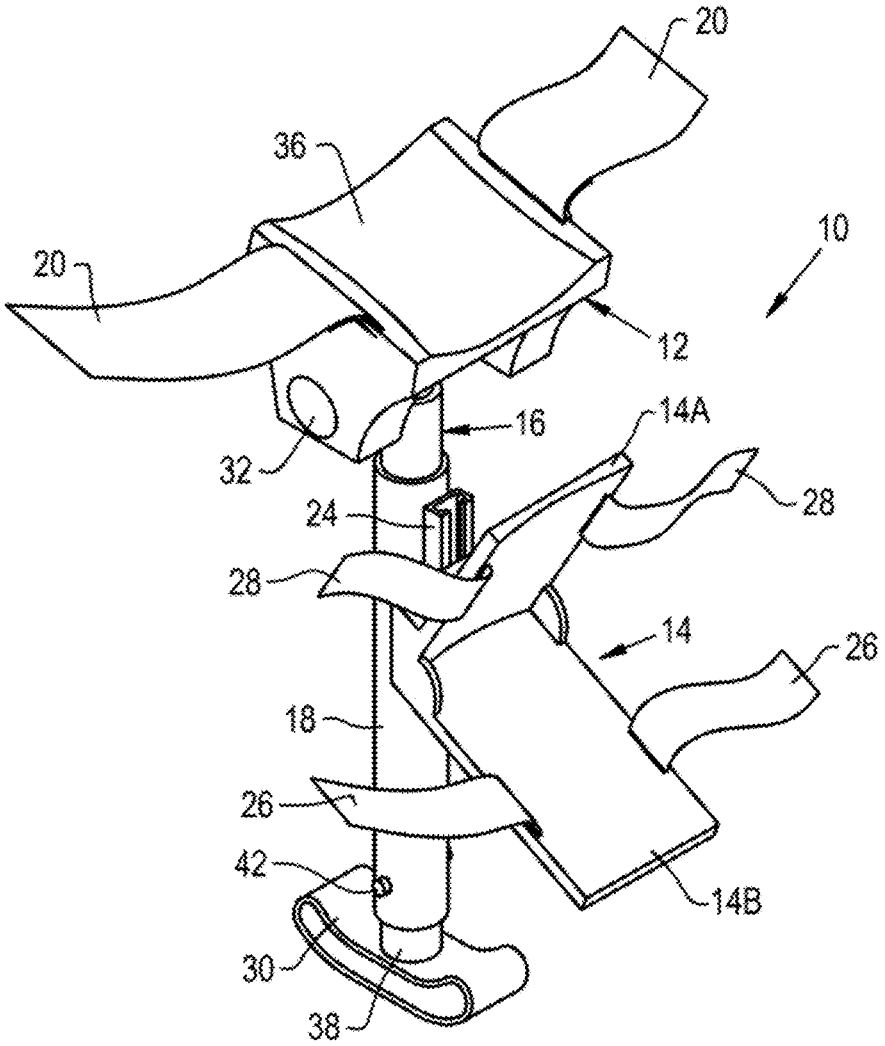
FIGS. 1, 2, and 3 are perspective, front, and side views, respectively, of a mobility device in accordance with a nonlimiting embodiment of the invention.

The seat 12 may be fabricated from a variety of materials, as a nonlimiting example, an ABS plastic material of a type commonly printed with 3D printers. The upper surface 36 of the seat 12 is arcuate-shaped to conform to the shape of the user's thigh, and preferably incorporates a foam material to promote the user's comfort. As represented in FIG. 1, the user's thigh can be secured to the seat 12 with hook-and-loop (e.g., VELCRO®) straps 20, though other securement means are also foreseeable, including belts, elastic bands, etc. The seat 12 is pivotally connected via a pivoting axle 22 to the gas spring 16 to allow the user to move their injured leg forward while walking, mimicking a typical human gait. The axle 22 is preferably mounted to the seat 12 with bearings so that the seat 12 is able to freely pivot relative to the longitudinal axis of the mobility device 10. The seat 12 and axle 22 may be cooperatively configured to have stop features (not shown) that prevent the user from overextending their injured leg. The connection of the seat 12 to the gas spring 16 includes an adjustment feature 40 (FIG. 2) that enables the overall longitudinal length of the device 10 to be adjusted.

The foot rest 14 may be fabricated from an ABS plastic material of a type commonly printed with 3D printers. The foot rest 14 is slidably mounted on a rail 24 attached to the foot rod 18. The coupling of the foot rest 14 to the rail 24 includes a biasing feature (not shown) so that the foot rest 14 is biased toward a null position, for example, midway along the length of the rail 24. In this manner, the foot rest 14 is able to longitudinally move along the longitudinal length of the rail 24 to ensure that an injury or other medical condition of the lower leg will experience minimal force. In preferred embodiments, the foot rest 14 is able to slide along the vertical (longitudinal) length of the foot rod 18 so that the foot rest 14 roughly moves in unison with the movement of the seat 12 in the longitudinal direction of the device 10 in response to the extension and retraction of the gas spring 16 as the weight of the user is applied to and removed from the device 10 when walking. As represented in FIG. 1, the user's foot can be secured to the foot rest 14 with a pair of hook-and-loop straps 26 configured to secure the user's foot to the lower portion 14B of the L-shaped foot rest 14, and a second pair of hook-and-loop straps 28 configured to secure the region of the user's leg immediately above the ankle to an upper portion 14A of the L-shaped foot rest 14, which together secure the foot to enable the user to comfortably move the device 10 forward. The foot rest 14 is preferably an interchangeable component of the device 10 to allow a user to install a foot rest 14 that closely accommodates the size and shape of their foot.

The device 10 has an interchangeable foot pad 30 at its lowermost end that provides a base for walking. The food pad 30 is preferably replaceable to accommodate different lifestyles and weather conditions. The foot pad 30 is coupled to the lower end of the foot rod 18 with a foot adjustment rod 38 that interconnects the foot pad 30 to the foot rod 18 and includes an adjustment feature 42 to enable adjustment of the foot pad 30 relative to the gas spring 16 of the device 10. As such, the adjustment rod 38 serves as a second location at which the overall length of the device 10 can be adjusted. The foot pad 30 can be constructed of a durable and impact resistant material, as nonlimiting examples, an aluminum or steel alloy, over which a resilient or pliable material may be applied to promote impact absorption and traction. Suitable but nonlimiting materials for the foot adjustment rod 38 include aluminum alloys.

Figure 2:
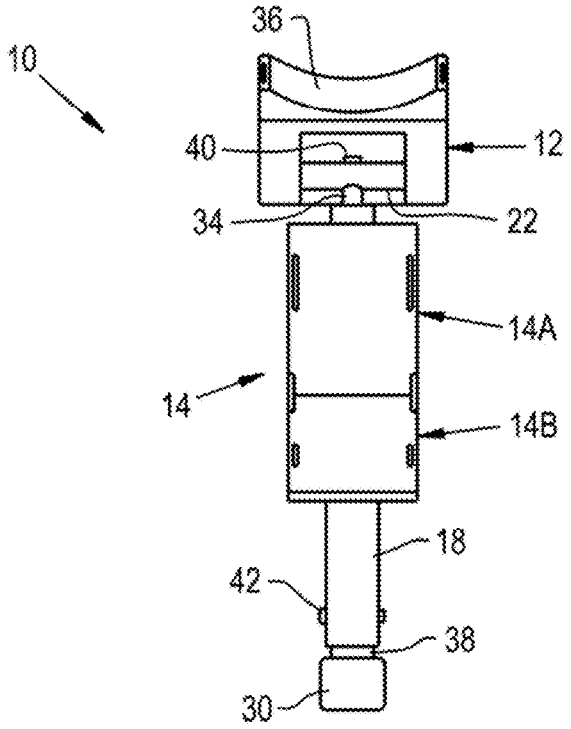

In FIGS. 1 through 3, the upper surface 36 of the seat 12 can be seen to be pivoted about its axle 22 to an angle other than perpendicular to the longitudinal axis of the mobility device 10. Furthermore, the lower portion 14B of the L-shaped foot rest 14 is disposed at a greater angle to the longitudinal axis than the upper portion of the foot rest 14. As a nonlimiting example, the upper and lower portions 14A and 14B are depicted in FIGS. 1 through 3 as disposed at angles of about 30 and 60 degrees, respectively, to the longitudinal axis of the device 10.

In FIGS. 1 and 3, seat caps 32 are shown attached to each sides of the seat 12 to close holes through which the pivoting seat axle 22 is installed to pivotally connect the seat 12 to the upper end 34 of the gas spring 16. Suitable but nonlimiting materials for the seat caps 32 include ABS plastics noted above as being commonly used in 3D printing, and suitable but nonlimiting materials for the seat axle 22 include aluminum alloys.

As previously noted, certain components depicted in FIGS. 1 through 4, for example, the seat 12, foot rest 14, gas spring 16, and foot pad 30 can be installed, removed, and replaced, allowing users of a wide range of heights, weights, and shapes to interchange components to provide a better fit.

Prototypes of the mobility device 10 shown in FIGS. 1 through 6 were subjected to testing in a systematic order. In one test, it was determined that the durability of the foot pad 30 could be enhanced by making the profile of the bottom of the foot pad 30 curved in the fore-aft direction, as shown in the drawings, allowing for a motion that decreases the moment arm at every angle of the stepping process. Further testing evidenced that the mobility of a user of the device 10 included the ability to turn, operate and pass through doorways, and navigate uneven terrain and stairs.

To confirm that minimal force is transmitted to a user's lower leg, an Arduino® microcontroller board configured for reading analog data was attached to the lower portion 14B of the foot rest 14 and a pressure sensor was attached to various locations on the device 10 at which force would be transmitted to a user during use. Tests conducted with the pressure sensor placed on the seat 12 showed that there was a roughly sinusoidal pressure output, in which a maximum pressure occurred when the user transferred all of their weight to the leg wearing the device 10, and a minimum pressure occurred when the user transferred essentially all of the weight to their other leg. When the output of the microcontroller board was switched to force readings, the maximum force output on the leg was roughly the weight of the user. Mounting the pressure sensor to the lower hook-and-loop straps 26 of the foot rest 14 indicated that there was essentially no force transmitted to the bottom of the user's foot. Mounting the pressure sensor to the upper hook-and-loop straps 28 of the foot rest 14 indicated that there was minimal force acting on this part of the foot/leg. The particular user of the prototype was subjected to a maximum force of approximately one-half pound (about 2 N), which indicated that the user would not likely risk injury to the foot of a leg on which the device 10 was being worn.

From the tests, it was concluded that the mobility device 10 offered a user improved mobility, reduced pressure exerted on an injured lower leg, and allowed hands-free use. Strapping the device 10 to the upper thigh enables a user to have their hands-free to perform daily tasks, and redistributes their weight to the upper thigh so that there is little if any significant force applied to injured parts of the lower leg, promoting the rehabilitation process. The redistribution of the weight to the upper thigh also appeared to increase a user's mobility and allow them to travel greater distances without concern for abrasions and nerve damage.

It is foreseeable that various modifications could be made to the mobility device 10 represented in the drawings. For example, various materials and modifications could be implemented to reduce the weight of the device 10. In addition, the mechanism by which the foot rest 14 is mounted to the foot rod 18 could be modified to promote or inhibit the freedom with which the foot rest 14 is able to translate along the length of the rod 18, and various securement systems could be employed to secure the device 10 to the thigh and foot. The incorporation of wireless pressure sensors and a Bluetooth-enabled controller in the device 10 is also foreseeable to enable the user or the user's physician to monitor the user's use of the device 10. For example, data acquired from one or more sensors embedded in the mobility device 10 (for example, as described above) could be wirelessly transmitted to a mobile electronic device, as nonlimiting examples, internet-connected mobile (portable) devices such as conventional smartphones, laptops, tablets, etc., as well as internet-connected browsers on personal computers. In this manner, sensor data could be viewed by the user and/or shared with a medical professional, who could then use the data to monitor the recovery of the user.

Figure 7:
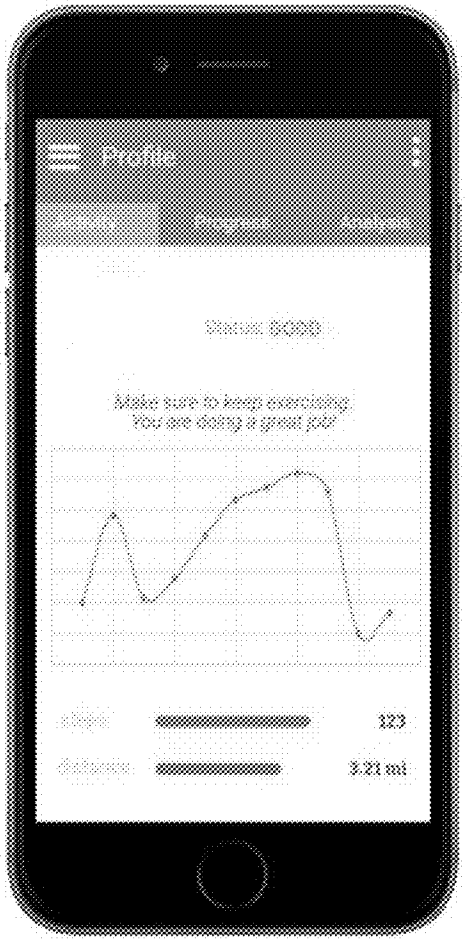
FIGS. 7 through 9 contain images showing various screens generated and displayed by an application ("app") on a mobile electronic device wirelessly connected to one or more sensors incorporated into the mobility device of FIGS. 1 through 4.
Figure 8:
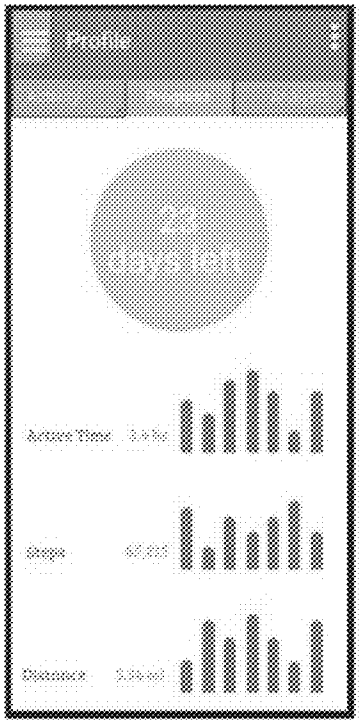
Figure 9:
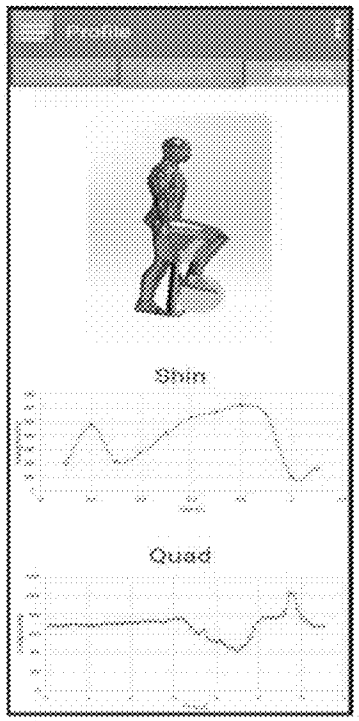

FIGS. 7 through 9 contain images showing various screens that may be generated and displayed by an application ("app") operating on a mobile electronic device that is wirelessly connected to one or more sensors embedded on the mobility device 10. Such an app can be adapted to provide a user with a visible record of their use of the device 10, as well as indicators of recovery relating to a leg injury or condition. Such a capability promotes communication between a patient and healthcare professionals. The app also preferably records and stores information that can be used to perform progressive analysis of recovery. FIG. 7 shows a screen of an activity page that allows a user to see the overall status of their recovery process. For example, FIG. 7 shows the app as tracking steps taken and distance traveled with the mobility device 10. FIG. 8 depicts a progress page of the app that shows a user the days estimated for recovery. The page also indicates the activity level of the user, steps taken, and distance traveled. FIG. 9 depicts an analysis page that displays recorded forces on regions of the user during their use of the device 10. Graphs show the user where and how much force is applied, enabling the user to make adjustments that may facilitate the recovery process. As such, the app can be used to record forces sensed by sensors mounted on the device 10 to determine whether the device 10 is being properly used, to encourage the user to use the device 10 correctly, and to offer advice to promote the recovery process.

In view of the forgoing, it can be appreciated that the mobility device 10 is intended to be capable of use on flat terrain, uneven terrain, sloped terrain, and stairs. The device 10 preferably requires less time to travel on each such terrain and stairs than would be possible for an individual using axillary crutches. Another design consideration is cost, and the mobility device 10 is intended to be affordable compared to competing devices.

While the invention has been described in terms of specific or particular embodiments and investigations, it should be apparent that alternatives could be adopted by one skilled in the art. For example, the mobility device 10 and its components could differ in appearance and construction from the embodiments described herein and shown in the drawings, functions of certain components of the device 10 could be performed by components of different construction but capable of a similar (though not necessarily equivalent) function, and appropriate materials could be substituted for those noted. In addition, the invention encompasses additional or alternative embodiments in which one or more features or aspects of different disclosed embodiments may be combined. Accordingly, it should be understood that the invention is not necessarily limited to any embodiment described herein or illustrated in the drawings. It should also be understood that the phraseology and terminology employed above are for the purpose of describing the illustrated embodiments and investigations, and do not necessarily serve as limitations to the scope of the invention. Therefore, the scope of the invention is to be limited only by the following claims.

The invention claimed is:

1. A mobility device for assisting a user with limited or altered mobility due to an injury or condition of a leg of the user, the mobility device comprising:

a rod that defines a longitudinal axis of the mobility device:

a foot rest slidably mounted for longitudinal translation along the rod;

a seat located at an upper end of the mobility device;

an impact-absorbing mechanism for absorbing impacts transferred from the seat to the rod;

means for securing the thigh of the user's leg to the seat;

means for securing the foot of the user's leg to the foot rest; and means for adjusting a longitudinal length of the mobility device;

wherein the foot rest is configured to slide along a length of a rail mounted to the rod so that the foot rest is able to move in unison with movement of the seat in a longitudinal direction of the mobility device in response to extensions and retractions of the impact-absorbing mechanism as weight of the user is applied to and removed from the mobility device when walking.

2. The mobility device according to claim 1, wherein the longitudinal length of the mobility device is adjustable at an interconnection between the seat and the impact-absorbing mechanism.

3. The mobility device according to claim 1, the mobility device further comprising a foot pad secured to a lower end of the rod.

4. The mobility device according to claim 3, wherein the longitudinal length of the mobility device is adjustable at an interconnection between the foot pad and the rod.

5. The mobility device according to claim 3, wherein a bottom surface of the foot pad has a profile that is curved in a fore-aft direction of the mobility device.

6. The mobility device according to claim 1, wherein the foot rest is L-shaped and has upper and lower portions, the lower portion being disposed at a greater angle to the longitudinal axis of the mobility device than the upper portion.

7. The mobility device according to claim 1, wherein the impact-absorbing mechanism is a gas spring.

8. The mobility device according to claim 1, further comprising at least one sensor incorporated into the mobility device to acquire data relating to force or pressure transferred by the mobility device to one or more regions of the user's lower leg.

9. The mobility device according to claim 8, further comprising means for wirelessly transmitting the data to a mobile electronic device to monitor the recovery of the user's lower leg.

10. A mobility device for assisting a user with limited or altered mobility due to an injury or condition of a leg of the user, the mobility device comprising:

a rod that defines a longitudinal axis of the mobility device:

a foot rest slidably mounted to the rod with a rail for longitudinal translation along the rod, the foot rest being biased toward a null position along a length of the rail, the foot rest having upper and lower portions, the lower portion being disposed at a greater angle to the longitudinal axis of the mobility device than the upper portion;

an impact-absorbing mechanism mounted to the rod for absorbing impacts transferred to the rod;

a seat located at an upper end of the mobility device and pivotally coupled to the rod by the impact-absorbing mechanism;

means for securing the thigh of the user's leg to the seat;

means for securing the foot of the user's leg to the lower portion of the foot rest;

means for securing a region of the user's leg above the ankle to the upper portion of the foot rest; and means for adjusting a longitudinal length of the mobility device;

wherein the foot rest is configured to slide along the length of the rail mounted to the rod so that the foot rest is able to move in unison with movement of the seat in a longitudinal direction of the mobility device in response to extensions and retractions of the impact-absorbing mechanism as weight of the user is applied to and removed from the mobility device when walking.

11. The mobility device according to claim 10, wherein the longitudinal length of the mobility device is adjustable at an interconnection between the seat and the impact-absorbing mechanism.

12. The mobility device according to claim 10, the mobility device further comprising a foot pad secured to a lower end of the rod.

13. The mobility device according to claim 12, wherein a bottom surface of the foot pad has a profile that is curved in a fore-aft direction of the mobility device.

14. The mobility device according to claim 12, wherein the longitudinal length of the mobility device is adjustable at an interconnection between the foot pad and the rod.

15. The mobility device according to claim 10, wherein the impact-absorbing mechanism is a gas spring.

16. The mobility device according to claim 10, wherein the foot rest is L-shaped.

17. The mobility device according to claim 10, further comprising at least one sensor incorporated into the mobility device to acquire data relating to force or pressure transferred by the mobility device to one or more regions of the user's lower leg.

18. The mobility device according to claim 10, further comprising a mobile electronic device that collects and displays data relating to force or pressure transferred by the mobility device to one or more regions of the user's leg.

* * * * *